US011253131B2

(12) United States Patent
Kwon

(10) Patent No.: US 11,253,131 B2
(45) Date of Patent: Feb. 22, 2022

(54) DISHWASHER AND CONTROLLING METHOD THEREFOR

(71) Applicant: LG Electronics Inc., Seoul (KR)

(72) Inventor: Yongtae Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 16/118,700

(22) Filed: Aug. 31, 2018

(65) Prior Publication Data

US 2019/0059683 A1 Feb. 28, 2019

(30) Foreign Application Priority Data

Aug. 31, 2017 (KR) ..... 10-2017-0111513
May 9, 2018 (KR) ..... 10-2018-0052831

(51) Int. Cl.

*A47L 15/00* (2006.01)
*A47L 15/08* (2006.01)
*A47L 15/42* (2006.01)
*F04D 13/16* (2006.01)
(Continued)

(52) U.S. Cl.

CPC ..... *A47L 15/0036* (2013.01); *A47L 15/0015* (2013.01); *A47L 15/08* (2013.01); *A47L 15/4225* (2013.01); *A47L 15/4234* (2013.01); *A47L 15/4244* (2013.01); *F04D 13/16* (2013.01); *F04D 29/586* (2013.01); *A47L 15/0002* (2013.01); *A47L 15/4214* (2013.01); *A47L 15/4221* (2013.01); *A47L 15/4285* (2013.01); *A47L 15/46* (2013.01); *A47L 2501/01* (2013.01); *A47L 2601/04* (2013.01)

(58) Field of Classification Search

CPC .. A47L 15/0036; A47L 15/0015; A47L 15/08; A47L 15/4225; A47L 15/4234; A47L 15/4244; A47L 15/0002; A47L 15/4214; A47L 15/4221; A47L 15/4285; A47L 15/46; A47L 2501/01; A47L 2601/04; F04D 13/16; F04D 29/586

See application file for complete search history.

(56) References Cited

U.S. PATENT DOCUMENTS

2005/0241675 A1* 11/2005 Jung ..... A47L 15/4244 134/18
2009/0235957 A1 9/2009 Kim
(Continued)

FOREIGN PATENT DOCUMENTS

WO WO2017022975 2/2017
WO WO-2017022975 A1 * 2/2017 ..... A47L 15/0013
WO WO2017022976 2/2017

OTHER PUBLICATIONS

Extended European Search Report in European Application No. 18191770.9, dated Jan. 29, 2019, 10 pages.

*Primary Examiner* — Sharidan Carrillo
(74) *Attorney, Agent, or Firm* — Fish & Richardson P.C.

(57) ABSTRACT

The present invention relates to a dishwasher for washing the dishes or the cooking utensils by spraying washing water and steam and a controlling method therefor. The method of controlling a dishwasher includes: a steam supply step of supplying washing water to the sump from an external water source; and a steam generation step of maintaining a water level of the washing water existing inside the washing pump at a certain water level or higher and heating the washing water.

20 Claims, 12 Drawing Sheets

(51) Int. Cl.
*F04D 29/58* (2006.01)
*A47L 15/46* (2006.01)

(56) References Cited

U.S. PATENT DOCUMENTS

| | | | | |
|---|---|---|---|---|
| 2010/0043829 | A1* | 2/2010 | Kim | A47L 15/0007 134/18 |
| 2014/0069469 | A1* | 3/2014 | Choi | A47L 15/4289 134/102.2 |
| 2015/0068565 | A1* | 3/2015 | Lee | C02F 1/42 134/56 D |
| 2015/0359411 | A1 | 12/2015 | Kim et al. | |
| 2017/0188778 | A1 | 7/2017 | Kim et al. | |
| 2017/0188781 | A1* | 7/2017 | Lee | A47L 15/4225 |
| 2017/0188784 | A1* | 7/2017 | Cho | A47L 15/4244 |
| 2017/0354306 | A1* | 12/2017 | Cho | A47L 15/0031 |
| 2018/0263459 | A1* | 9/2018 | Kim | A47L 15/4225 |
| 2018/0271350 | A1* | 9/2018 | Woo | F04D 29/588 |
| 2019/0059691 | A1* | 2/2019 | Yang | A47L 15/4225 |

* cited by examiner

| PRELIMINARY WASHING 1 (P310) | PRELIMINARY WASHING 2 (P320) | PRELIMINARY WASHING 3 (P330) | STEAM WASHING (P340) | MAIN WASHING (P350) | RINSING (P360) | HEAT RINSING (P370) |
|---|---|---|---|---|---|---|

DISHWASHER AND CONTROLLING METHOD THEREFOR

CROSS-REFERENCE TO RELATED APPLICATIONS

This application claims the priority benefit of Korean Patent Application Nos. 10-2017-0111513, filed on Aug. 31, 2017, and 10-2018-0052831, filed on May 9, 2018, the disclosures of which are incorporated herein by reference in their entirety.

FIELD

The present invention relates to a dishwasher and a controlling method therefor, and more particularly, to a dishwasher for washing the dishes or the cooking utensils by spraying washing water and steam, and a controlling method therefor.

BACKGROUND

A dishwasher is a household appliance for washing up dirt such as food wastes on the dishes or the cooking utensils (hereinafter, referred to as 'washing object') by high-pressure washing water sprayed from a spray arm.

The dishwasher generally includes a tub forming a washing chamber and a sump mounted on the bottom of the tub to store the washing water. Then, the washing water is moved to the spray arm by the pumping operation of a washing pump installed inside the sump, and the washing water moved to the spray arm is sprayed at high pressure through a spray hole formed in the spray arm. Then, the washing water sprayed at a high pressure impinges against the surface of the washing object, so that the dirt on the washing object falls to the bottom of the tub.

Meanwhile, the dishwasher performs washing of the washing object by using a heated washing water or performs sterilization by supplying steam to the washing object. Conventional dishwashers generally generate hot water or steam by heating washing water stored in the sump through a heater provided inside the sump. In this case, since the heater should be exposed to the inside of the sump to contact the washing water, the water level inside the sump should be controlled so that the heater is not exposed to prevent overheating of the heater. In addition, since the heat transfer is possible only when the heater is in contact with the washing water, there exists a problem in that the heat exchange efficiency is lowered as foreign matter adheres to the surface of the heater and durability is deteriorated as the surface of the heater is corroded.

In order to overcome such disadvantages, a dishwasher in which a heater is installed on a pump has recently been developed. In this case, the heater heats the washing water inside the pump to generate hot water or steam. Control is required to appropriately achieve generation of steam through such a washing pump.

SUMMARY

The present invention has been made in view of the above problems, and provides a dishwasher in which steam is generated appropriately by controlling a washing pump, and a control method therefor.

In accordance with an aspect of the present invention, a method of controlling a dishwasher includes: a steam supply step of supplying washing water to the sump from an external water source; and a steam generation step of maintaining a water level of the washing water existing inside the washing pump at a certain water level or higher and heating the washing water.

The method further includes a sump washing step of supplying the washing water to the sump from an external water source before the steam supply step and then draining the washing water supplied to the sump.

In the sump washing step, the washing pump does not operate.

The water level of the washing water supplied to the sump in the steam supply step is lower than the water level of the washing water supplied to the sump in the sump washing step.

The washing pump includes a steam discharge pipe connected to the steam nozzle to discharge steam generated therein, and an amount of washing water supplied to the sump in the steam supply step is set so that the water level of the washing water when flowing into the washing pump is lower than a lowermost end of the steam discharge pipe.

The method further includes: a washing process step of spraying the washing water on a washing object to remove dirt attached to the washing object; and a steam washing process step of discharging steam to the washing object, wherein the steam washing process step comprises the steam supply step and the steam generation step, wherein the water level of the washing water supplied to the sump in the steam supply step is lower than the water level of the washing water supplied to the sump in the washing process step.

The plurality of spray arms are disposed vertically, wherein the washing pump is connected to a spray arm which is disposed at an uppermost end of the plurality of spray arms in the steam generation step.

The method further includes: a hot water circulation step for heating the washing water and sending the washing water to at least one of the plurality of spray arms by the washing pump, before the steam generation step.

In the steam generation step, when the hot water circulation step is completed, the water level of the washing water existing inside the washing pump is maintained at a certain level or higher and the heated washing water stored in the washing pump is heated to generate steam.

Execution time of the steam generation step is longer than execution time of the hot water circulation step.

The hot water circulation step and the steam generation step are repeatedly performed.

A temperature at which the washing pump heats the washing water in the steam generation step is higher than a temperature at which the washing pump heats the washing water in the hot water circulation step.

The washing pump sends the washing water to all of the plurality of spraying arms in the hot water circulation step.

The dishwasher further includes: a check valve which is disposed between the sump and the washing pump, wherein the check valve is opened to allow the washing water to flow from the sump to the washing pump in the hot water circulation step.

In accordance with another aspect of the present invention, a dishwasher includes: a tub which accommodates a washing object; a plurality of spray arms which spray washing water into the tub and are disposed vertically; a sump which stores the washing water; a washing pump comprising an impeller which sends the washing water stored in the sump and a washing motor which rotates the impeller; a heater which heats the washing water inside the washing pump; and a controller which controls the washing motor and the heater, wherein the controller operates the heater to generate steam while maintaining water level of the washing water existing inside the washing pump at a certain level or higher.

The dishwasher further includes: a switching valve which selectively connects the washing pump with at least one of the plurality of spray arms, wherein the controller controls the switching valve to connect the washing pump to a spray arm which is disposed at an uppermost end of the plurality of spray arms, when generating the steam.

The controller operates the washing motor and the heater simultaneously to spray heated washing water through at least one of the plurality of spray arms and then operates the heater to generate steam in a state of maintaining the water level of the washing water existing inside the washing pump at a certain level or higher.

The dishwasher further includes: a check valve disposed between the sump and the washing pump, wherein the check valve is opened to allow the washing water to flow from the sump to the washing pump when the washing motor operates, and is closed to allow the washing water to be stored inside the washing pump when the washing motor is stopped.

The dishwasher further includes: a water supply valve which intermits washing water supplied from an external water source; and a draining pump which drains the washing water stored in the sump to the outside, wherein the controller opens the water supply valve to supply the washing water from the external water source to the sump, and then operates the draining pump to drain the washing water supplied to the sump, wherein the controller does not operate the washing motor and the heater from the opening of the water supply valve to the operation of the draining pump.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a dishwasher and a controlling method therefor according to embodiments of the present invention.

Figure 1:
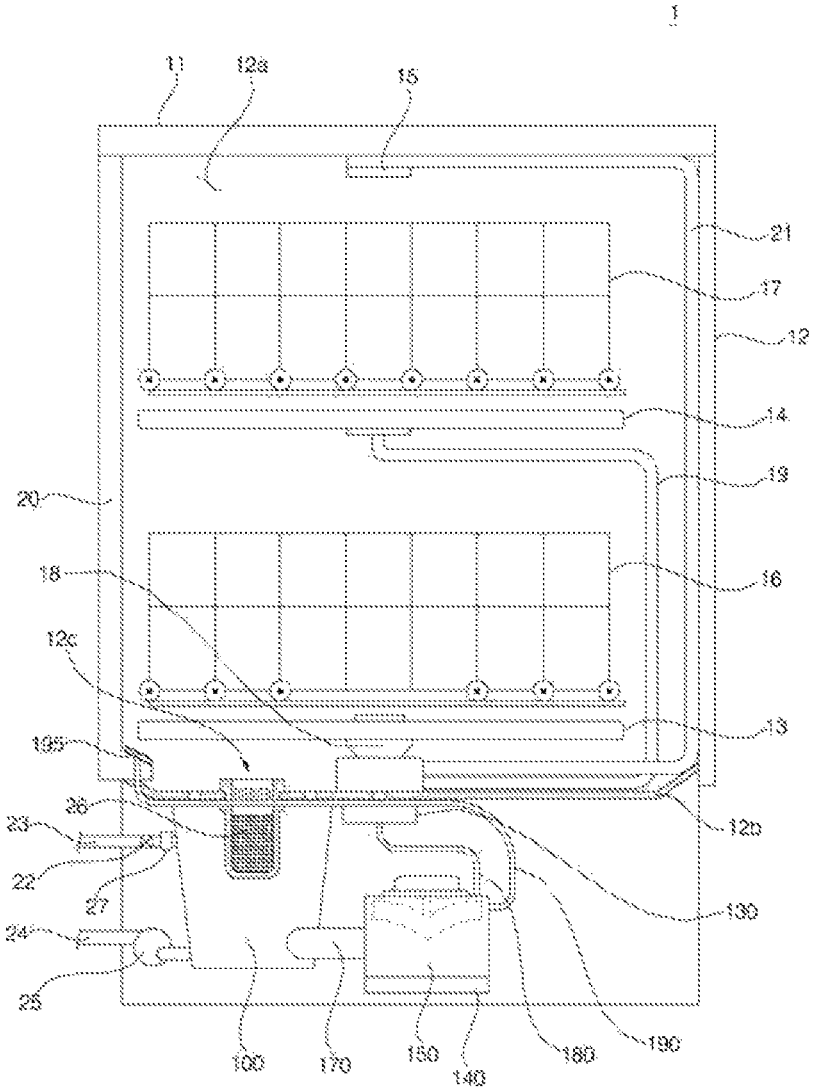
FIG. 1 is a schematic structural view of a dishwasher according to an embodiment of the present invention.
Figure 2:
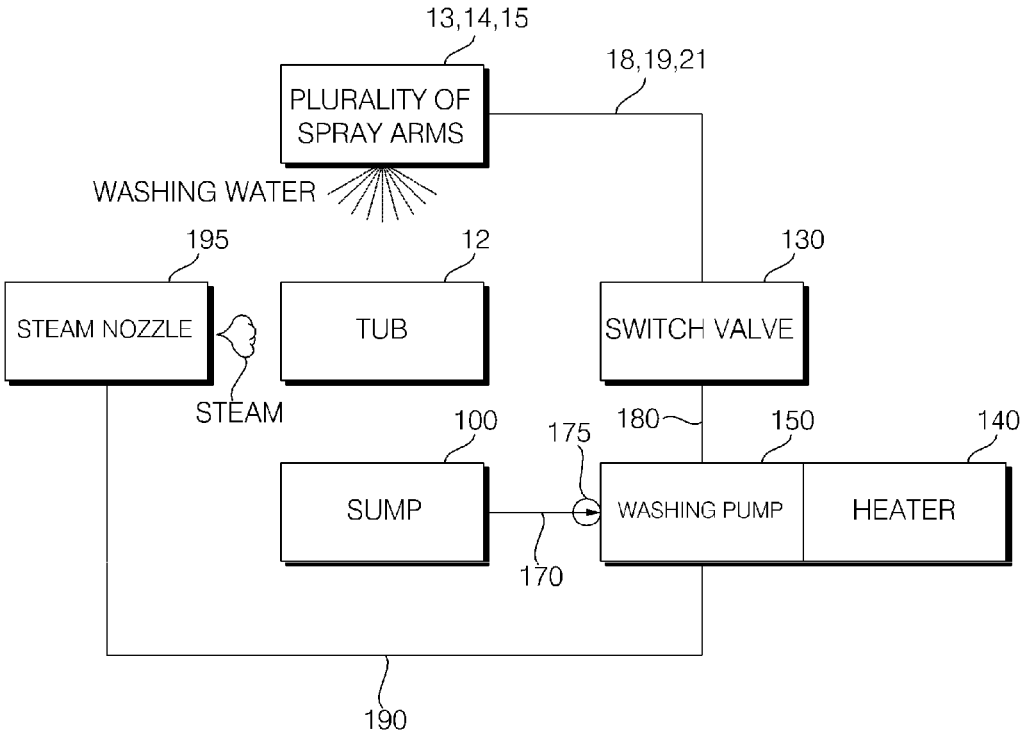
FIG. 2 is a configuration view of a dishwasher according to an embodiment of the present invention.

FIG. 1 is a schematic structural view of a dishwasher according to an embodiment of the present invention, and FIG. is a configuration view of a dishwasher according to an embodiment of the present invention.

The dishwasher 1 according to an embodiment of the present invention includes a case 11 that forms an outer appearance, a tub 12 that is provided inside the case 11 and forms a washing chamber 12*a* in which a washing object is accommodated, a door 20 that is provided on the front surface of the tub 12 and opens and closes the washing chamber 12*a*, a sump 100 that is disposed below the tub 12 and stores washing water, a plurality of spray arms 13, 14, 15 that spray washing water into the tub 12, a washing pump 150 that sends washing water stored in the sump 100 to the plurality of spray arms 13, 14, 15, a heater 140 that heats the washing water inside the washing pump 150, a check valve 175 that is disposed between the sump 100 and the washing pump 150 and opened to allow the washing water to flow from the sump 100 to the washing pump 150, a steam nozzle 195 that is provided in the door 20 and discharges the steam generated in the washing pump 150 into the tub 12, a switching valve 130 that selectively connects the washing pump 150 to at least one of the plurality of spray arms 13, 14, and 15, a water supply valve 22 that supplies the washing water from an external water source to the sump 100, a flow meter 27 that measures the flow rate of the washing water supplied from the external water source to the sump 100, and a draining pump 25 that drains the washing water stored in the sump 100 to the outside, The tub 11 is formed in a hexahedron shape having an opened front surface and forms a washing chamber 12*a* therein. A communication hole 12*c* through which the washing water flows into the sump 100 is formed in a bottom 12*b* of the tub 11. The washing chamber 12*a* is provided with a plurality of racks 16 and 17 for receiving the washing object. The plurality of racks 16 and 17 include a lower rack 16 disposed at a lower portion of the washing chamber 12*a* and an upper rack 17 disposed at an upper portion thereof. The lower rack 16 and the upper rack 17 are vertically spaced apart and can be slid forwardly of the tub 11 to be drawn out.

The plurality of spray arms 13, 14, and 15 are disposed in the vertical direction. The plurality of spray arms 13, 14, and 15 include a lower spray arm 13 which is disposed in the lowermost end and sprays washing water from the lower side to the upper side toward the lower rack 16, an upper spray arm 14 which is disposed in the upper side of the lower spray arm 13 and sprays washing water from the lower side to the upper side toward the upper rack 17, and a top spray arm 15 which is disposed in the upper end of the washing chamber 12*a* that is above the upper spray arm 14 and sprays washing water from the upper side to the lower side.

The plurality of spray arms 13, 14, and 15 are supplied with the washing water from the washing pump 150 through a plurality of spray arm connecting flow paths 18, 19, and 21. The plurality of spray arm connecting flow paths 18, 19, and 21 include a lower spray arm connecting flow path 18 connected to the lower spray arm 13, an upper spray arm connecting flow path 19 connected to the upper spray arm 14, and a top spray arm connecting flow path 21 connected to the top spray arm 15.

The sump 100 is disposed below the bottom 12*b* of the tub 12 to collect washing water. The sump 100 is connected to a water supply flow path 23 through which washing water supplied from an external water source flows. The water supply flow path 23 is provided with the water supply valve 22 for intermitting washing water supplied from the external water source. When the water supply valve 22 is opened, the washing water supplied from the external water source flows into the sump 100 through the water supply flow path 23. The water supply flow path 23 is provided with a flow meter 27 for measuring the flow rate of the washing water flowing into the sump 100 through the water supply flow path 23.

The sump 100 is connected to a drainage flow path 24 for guiding the stored washing water to the outside of the dishwasher 1. The drainage flow path 24 is provided with the draining pump 25 for draining the washing water in the sump 100 through the drainage flow path 24. The draining pump 25 includes a draining motor (not shown) for generating a rotational force. When the draining pump 25 is operated, the washing water stored in the sump 100 flows to the outside of the case 11 through the drainage flow path 24.

A filter 26 is installed in the communication hole 12*c* to filter the dirt from the washing water moving from the tub 12 to the sump 100.

The washing pump 150 sends the washing water stored in the sump 100 to at least one of the plurality of spray arms 13, 14 and 15. The washing pump 150 is connected to the switching valve 130 and a washing water supply path 180. When the washing pump 150 is operated, the washing water stored in the sump 100 flows into the washing pump 150 through a water collecting flow path 170 and is then sent to the switching valve 130 through the washing water supply flow path 180. A check valve 175 is provided inside the water collecting flow path 170 or between the water collecting flow path 170 and the washing pump 150.

The washing pump 150 is installed at one lateral side of the sump 100. The washing pump 150 is connected to a steam hose 190. The steam generated in the washing pump 150 is supplied to a steam nozzle 195 through the steam hose 190.

The heater 140 is coupled to the lower side of the washing pump 150 to heat the washing water in the washing pump 150. The heater 140 generates hot water by heating the washing water flowing in the washing pump 150 when the washing pump 150 operates. The heater 140 generates steam by heating the washing water existing inside the washing pump 150 while maintaining the level of the washing water existing inside the washing pump 150 at a certain level or higher. Accordingly, the heater 140 generates steam by heating the washing water existing inside the washing pump 150, while intermittently operating the washing pump 150, or the heater 140 generates steam by heating the washing water stored in the washing pump 150, when the washing pump 150 is stopped.

The hot water generated by the heater 140 is sprayed into the tub 12 through at least one of the plurality of spray arms 13, 14, and 15. The steam generated by the heater 140 flows along the steam hose 190 and is discharged into the tub 12 through the steam nozzle 195.

The steam nozzle 195 is provided at the lower end of the door 20 to discharge the steam generated by the heater 140 to the washing chamber 12*a*. The steam discharged from the steam nozzle 195 is applied to the washing object accommodated in the lower rack 16 and/or the upper rack 17.

The switching valve 130 selectively connects the sump 100 to at least one of the plurality of spray arms 13, 14, and 15. The switching valve 130 selectively supplies the washing water sent by the washing pump 150 to at least one of the lower spray arm 13, the upper spray arm 14, and the top spray arm 15. The switching valve 130 selectively connects the washing water supply flow path 180 and at least one of the plurality of spray arm connecting flow paths 18, 19, and 21. The switching valve 130 is disposed in the sump 100.

The check valve 175 is disposed between the sump 100 and the washing pump 150 and is opened in the direction of the washing pump 150 from the sump 100. The check valve 175 is opened to allow the washing water to flow from the sump 100 to the washing pump 150 and is closed to allow the steam not to flow from the washing pump 150 to the sump 100. The check valve 175 is opened by rotating the lower portion around the upper portion. The check valve 175 is disposed inside the water collecting flow path 170 or connected between the water collecting flow path 170 and the washing pump 150 to open and close the water collecting flow path 170.

The check valve 175 is opened when the washing pump 150 operates to flow the washing water, and is closed when the washing pump 150 stops and the washing water does not flow. The check valve 175 is opened by the flow pressure of the washing water of the washing pump 150. According to an embodiment, the check valve 175 may be a solenoid valve that is opened or closed by an electronic signal.

The check valve 175 is formed to allow the washing water to flow from the washing pump 150 to the sump 100 even when it is closed during operation of the draining pump 25.

Figure 3:
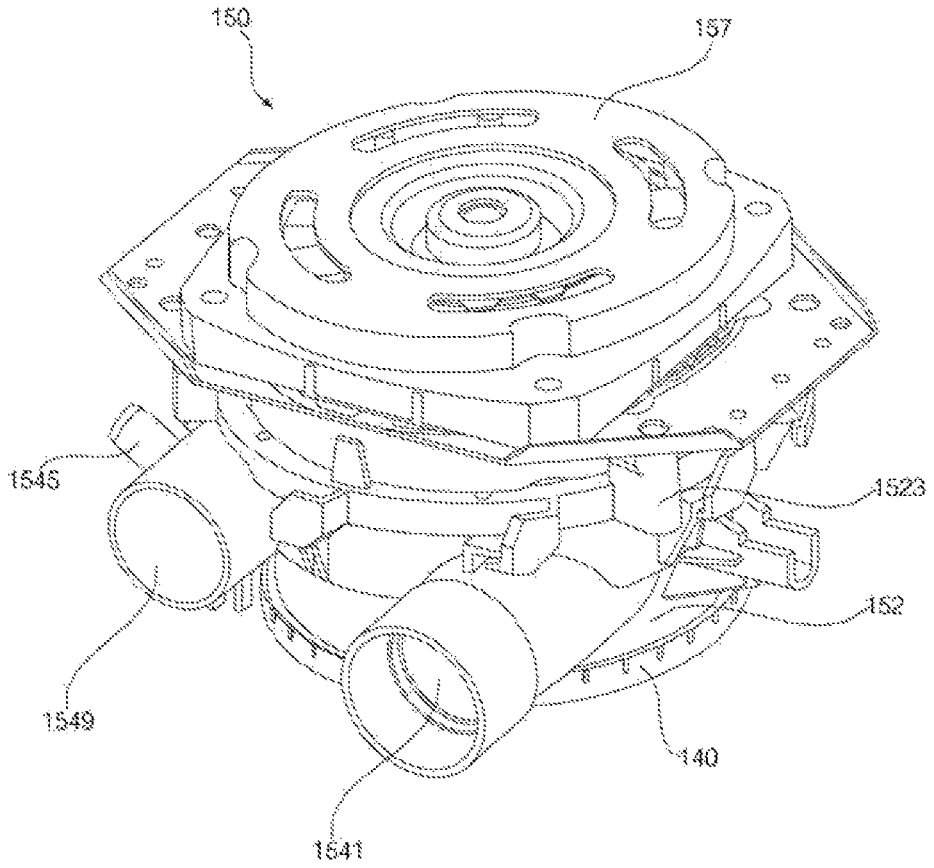
FIG. 3 is a perspective view of a washing pump according to an embodiment of the present invention.
Figure 4:
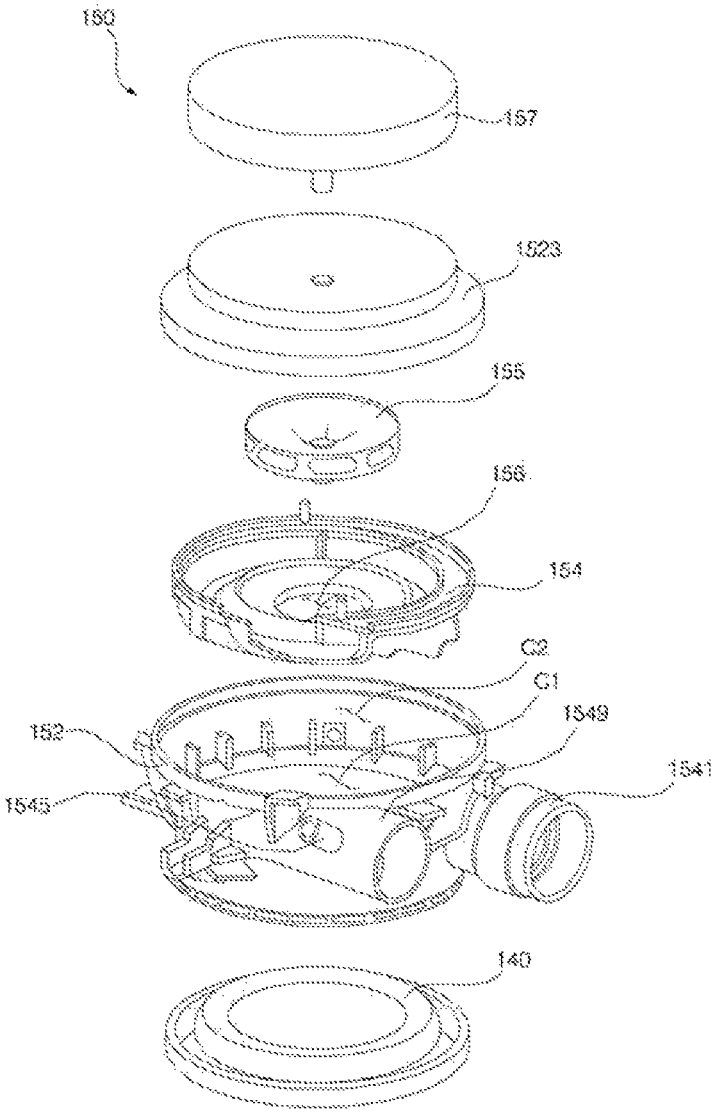
FIG. 4 is an exploded perspective view of a washing pump according to an embodiment of the present invention.
Figure 5:
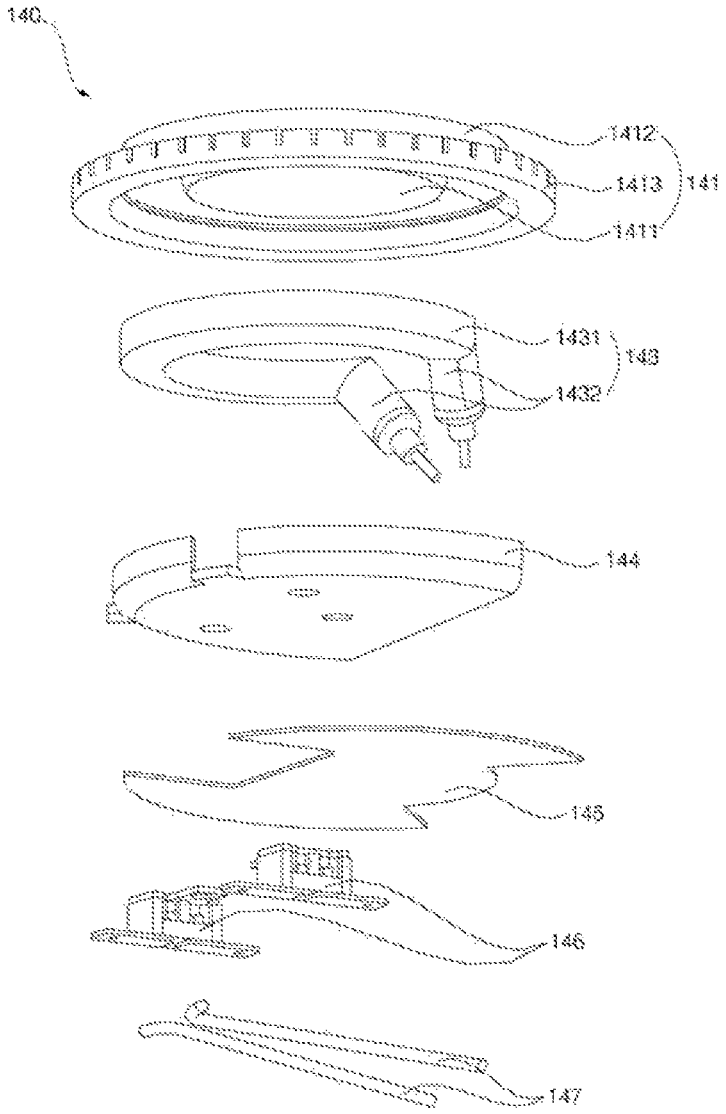
FIG. 5 is an exploded perspective view of a heater according to an embodiment of the present invention.
Figure 6:
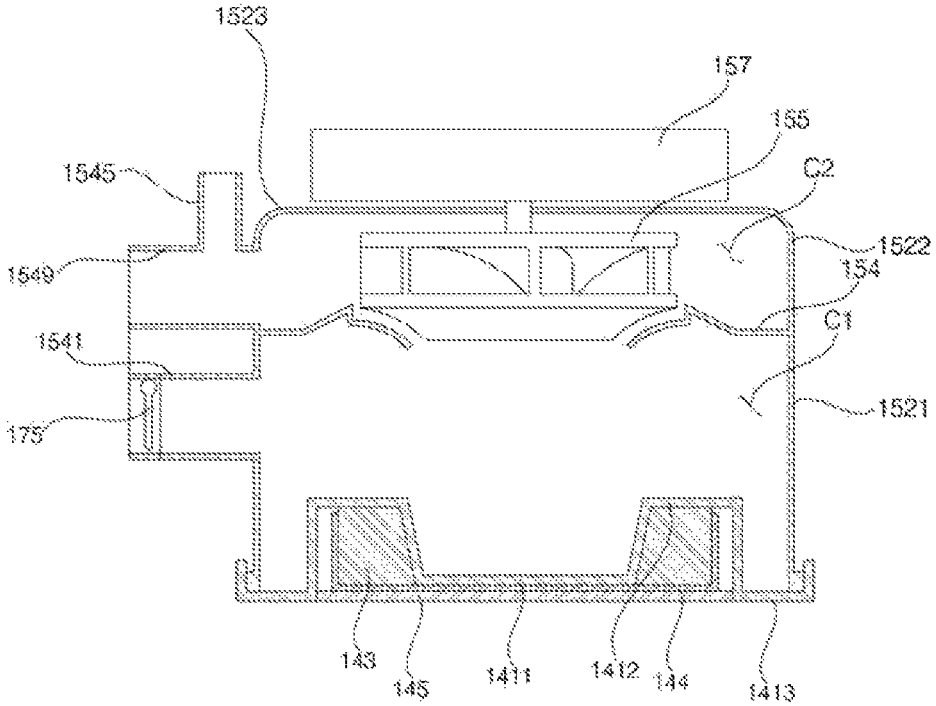
FIG. 6 is a schematic cross-sectional view of a washing pump according to an embodiment of the present invention.

FIG. 3 is a perspective view of a washing pump according to an embodiment of the present invention, FIG. 4 is an exploded perspective view of a washing pump according to an embodiment of the present invention, FIG. 5 is an exploded perspective view of a heater according to an embodiment of the present invention, and FIG. 6 is a schematic cross-sectional view of a washing pump according to an embodiment of the present invention.

The washing pump 150 according to an embodiment of the present invention includes a cylindrical housing 152 which is coupled to the sump 100, a washing water intake pipe 1541 which is connected to the housing 152 and through which the washing water flows into the housing 152 by the rotation of an impeller 155, a washing water outflow pipe 1549 which is connected to the housing 152 and through which the washing water is discharged to the outside of the housing 152 by the rotation of the impeller 155, an impeller 155 which is disposed inside the housing 152 and sends the washing water introduced into the washing water intake pipe 1541 to the washing water outflow pipe 1549, a washing motor 157 which rotates the impeller 155, a heater 140 which is coupled to the housing 152 and generates steam by heating the washing water inside the housing 152, and a steam discharge pipe 1545 which is disposed in the washing water outflow pipe 1549 and discharges steam generated by the heater 140.

The housing 152 is formed in a cylindrical shape having opened top and bottom surfaces. The housing 152 is coupled to the sump 100. A housing cover 1523 is coupled to the upper end of the housing 152, and the heater 140 is coupled to the lower end thereof. The housing cover 1523 covers the upper portion of the housing 152, and the housing cover 1523 is provided with the washing motor 157 for rotating the impeller 155 by generating a rotational force.

A partition wall 154 is disposed inside the housing 152. The partition wall 154 is disposed at the middle end of the housing 152 to divide an internal space vertically. The partition wall 154 is disposed below the impeller 155. The partition wall 154 is disposed above the washing water intake pipe 1541 and disposed below the washing water outflow pipe 1549. The partition wall 154 forms a lower chamber C1 and an upper chamber C2 inside the housing 152. The lower chamber C1 is the place where a negative pressure is generated by the rotation of the impeller 155 and the upper chamber C2 is the place where the impulse 155 is accommodated and a positive pressure is generated by the rotation of the impeller 155. The lower chamber C1 is connected to the sump 100 through the water collecting flow path 170 and the washing water intake pipe 1541. The upper chamber C2 is connected to the switching valve 130 through the washing water outflow pipe 1549 and the washing water supply flow path 180. In addition, it is connected to the steam nozzle 195 through the steam discharge pipe 1545 and the steam hose 190.

The partition wall 154 divides the washing pump 150 into a pump lower portion 1521 through which the washing water is introduced by the rotation of the impeller 155 and a pump upper portion 1522 through which the washing water is discharged by the rotation of the impeller 155. The washing water is introduced to the inside of the pump lower portion 1521, and the lower chamber C1 is formed in the inside of the pump lower portion 1521. The pump lower portion 1521 includes a lower portion of the housing 152 and the washing water intake pipe 1541. The pump lower portion 1521 may further include a heater cover 141 of the heater 140.

The pump upper portion 1522 discharges washing water or steam to the outside, and forms the upper chamber C2 therein. The pump upper portion 1522 includes an upper portion of the housing 152, the washing water outflow pipe 1549, the steam discharge pipe 1545, and the housing cover 1523. The impeller 155 is disposed inside the pump upper portion 1522 and the washing motor 157 is disposed in the upper side of the pump upper portion 1522.

The partition wall 154 includes a partition hole 156 for communicating the lower chamber C1 and the upper chamber C2. The upper surface of the upper chamber C2 side of the partition wall 154 is formed in a volute shape so that the washing water introduced to the upper chamber C2 through the partition hole 156 from the lower chamber C1 is guided to the washing water outflow pipe 1549. A guider (not shown) protruding downward is formed on the lower surface of the lower chamber C1 side of the partition wall 154. The guider of the partition wall 154 guides the washing water introduced into the lower chamber C1 through the washing water intake pipe 1541 to the partition wall hole 156. The guider of the partition wall 154 allows the washing water in the lower chamber C1 to be uniformly heated by the heater 140.

The impeller 155 is rotated by the washing motor 157 and flows the washing water in the housing 152 to send to the outside. The impeller 155 is rotatably disposed in the upper chamber C2. The impeller 155 sends the washing water introduced into the upper chamber C2 from the lower chamber C1 through the partition hole 156 to the washing water outflow pipe 1549.

The washing water intake pipe 1541 is connected to the lower chamber C1 side of the housing 152. The washing water intake pipe 1541 is connected to the water collecting flow path 170 to allow the washing water of the sump 100 to flow into the lower chamber C1. The washing water intake pipe 1541 is disposed to protrude outward from the lower sidewall of the housing 152. The washing water intake pipe 1541 is disposed in such a manner that the pipe direction is horizontal, so that the washing water flows in the horizontal direction.

The washing water outflow pipe 1549 is connected to the upper chamber C2 side of the housing 152. The washing water outflow pipe 1549 is connected to the washing water supply flow path 180 so that the washing water in the upper chamber C2 is discharged to the washing water supply flow path 180. The washing water outflow pipe 1549 is disposed to protrude outward from the upper side wall of the housing 152. The washing water outflow pipe 1549 is horizontally disposed so that the washing water flows in a horizontal direction.

The steam discharge pipe 1545 is connected to the upper chamber C2 side of the housing 152. The steam discharge pipe 1545 is disposed above the partition wall 154. The steam discharge pipe 1545 may be disposed at various positions of the housing 152 so as to connect the upper chamber C2 of the housing 152 and the steam hose 190. In the present embodiment, the steam discharge pipe 1545 is disposed in the washing water outflow pipe 1549. The steam discharge pipe 1545 is disposed to be inclined so that the steam discharge direction is inclined upward. The steam discharge direction of the steam discharge pipe 1545 is perpendicular to the washing water discharge direction of the washing water outflow pipe 1549.

The steam discharge pipe 1545 is connected to the steam hose 190 and discharges the steam generated in the housing 152 by the heater 140 to the steam hose 190. The steam hose 190 is connected to the upper chamber C2 through the steam discharge pipe 1545.

The heater 140 is connected to the lower end of the housing 152 to form a bottom surface of the housing 152. The heater 140 heats the washing water flowing inside the housing 152 when the impeller 155 rotates. The heater 140 generates steam by heating the washing water stored inside the housing 152. The heater 140 is disposed below the washing water intake pipe 1541. The heater 140 is disposed below the partition wall 154. A part of the heater 140 is disposed inside the housing 152.

The check valve 175 is coupled to the washing water intake pipe 1541. The upper end of the check valve 175 is coupled to the upper end of the washing water intake pipe 1541. The check valve 175 is opened when the impeller 155 rotates and is closed when the impeller 155 does not rotate. The check valve 175 is opened when the washing motor 157 is operated and closed when the washing motor 157 is stopped. The check valve 175 is closed when the heater 140 generates steam so that the steam generated inside the housing 152 is prevented from flowing out to the sump 100 through the lower chamber C1 and the washing water intake pipe 1541. However, when steam is generated while the impeller 155 rotates, the check valve 175 may be opened such that the level of the washing water existing inside the housing 152 is maintained at a certain level or higher.

The check valve 175 is configured to allow the washing water to flow from the washing pump 150 to the sump 100 during operation of the draining pump 25. The check valve 175 is formed in such a manner that a part of the lower portion of the washing water intake pipe 1541 is opened when it is closed. The check valve 175 is formed to block 50% to 90% of the cross-sectional area of the washing water intake pipe 1541 when it is closed, and is preferably formed to cover 70% of the cross-sectional area of the washing water intake pipe 1541.

The check valve 175 may be closed to prevent the washing water and the steam from flowing from the washing pump 150 to the sump 100 during the steam generation of the heater 140. However, when steam is generated, while the impeller 155 rotates, the check valve 175 may be opened such that the level of the washing water existing in the housing 152 is maintained at a certain level or higher. When the draining pump 25 and the motor 157 are stopped (when not operating), the check valve 175 may store the washing water inside the housing 152. The heater 140 heats the washing water stored inside the housing 152 by the check valve 175 and generates steam.

The heater 140 according to an embodiment of the present invention includes a heater cover 141 which forms a bottom surface of the housing 152, a heating element 143 which is joined to the lower side of the heater cover 141 and heats the heater cover 141, a heater plate 144 which is joined to the lower side of the heating element 143 and the heater cover 141 and transfers the heat of the heating element 143 to the heater cover 141, a thermostat 146 which supplies power to the heating element 143 and adjusts the temperature of the heating element 143, a wire 147 which electrically connects the heating element 143 and the thermostat 146, and a heater shield 145 which covers a part of the heater plate 144 from the lower side.

The heater cover 141 is coupled to the lower end of the housing 152 and forms the bottom surface of the housing 152 of the washing pump 150. The upper surface of the heater cover 141 is in contact with the washing water. The heating element 143 and the heater plate 144 are joined to the lower side of the heater cover 141. The heater cover 141 is heated by the heating element 143 and the heater plate 144 to heat the washing water.

The circumference of the heater cover 141 is formed in a circular shape, and a plurality of bends in a vertical direction are formed at the position of concentric circle. The heater cover 141 is partly annularly protruded upward (toward the partition wall 154 side of the washing pump 150). A part of the heater cover 141 protrudes inward of the housing 152 to form an annular space in which a part of the heating element 143 is accommodated. A part of the heater cover 141 is disposed between the washing water accommodated in the housing 152 and the heating element 143. Thus, the heating element 143 is not in contact with the washing water accommodated in the housing 152.

The heater cover 141 includes a cover base 1411 having a disk shape, a cover holder 1412 protruding upward from the circumference of the cover base 1411, and a cover rim 1413 which is formed around the cover holder 1412 and is coupled with the housing 152.

The cover base 1411 is formed of a circular plate and forms a central portion of the heater cover 141. The central portion of the heater plate 144 is joined to the lower side of the cover base 1411. The cover base 1411 and the central portion of the heater plate 144 are joined by brazing.

The cover holder 1412 is formed in a ring shape protruding upward. The cover holder 1412 forms an annular space in which a part of the heating element 143 is accommodated. In the annular space of the cover holder 1412, a heating main body 1431 of heating element 143 described later is accommodated. A part of the heating element 143 is joined to the inside of the cover holder 1412. The cover holder 1412 and a part of the heating element 143 are joined by brazing.

The longitudinal section from the center to the radial direction of the cover holder 1412 is formed in an open curve whose lower side is open. At least part of the cover holder 1412 is formed to correspond to a part of the shape of the heating element 143 accommodated in the annular space of the cover holder 1412. The cover holder 1412 accommodates a part of the heating element 143 and is in direct contact with a part of the heating element 143. The inner surface of the outer circumference of the cover holder 1412 is spaced apart from the outer circumferential surface of a part of the heating element 143 accommodated in the annular space of the cover holder 1412.

The cover rim 1413 is formed in a rim shape. The cover rim 1413 is formed to surround the lower end of the housing 152. The circumferential end of the cover rim 1413 protrudes upward and is coupled with the housing 152. Since the cover rim 1413 is not in contact with the heater plate 144 and the heating element 143, it is heated to a relatively low temperature.

The heating element 143 receives power from the thermostat 146 through a wire 147 and generates heat. The heating element 143 heats the heater cover 141 and the heater plate 144. The heater cover 141 is joined to the upper side of the heating element 143 by brazing, and the heater plate 144 is joined to the lower side thereof by brazing.

The outer circumference of a part of the heating element 143 is spaced apart from the portion of the heater cover 141 forming an annular space. A part of the heating element 143 is accommodated in the annular space formed in the heater cover 141 and disposed inside the housing 152. The heating element 143 is disposed below the heater cover 141 forming the bottom surface of the housing 152 and disposed in the outside of the washing pump 150 but partially disposed in the inside of the housing 152.

The heating element 143 includes an arc-shaped heating main body 1431 for generating heat and a heating terminal 1432 for supplying power to the heating main body 1431.

The heating main body 1431 is formed in an arc shape whose center angle is larger than 180 degrees. The heating main body 1431 is accommodated inside the cover holder 1412. The upper surface and the inner circumferential surface of the heating main body 1431 come into contact with the heater cover 141 to heat the heater cover 141. The lower surface and the outer circumferential surface of the heating main body 1431 are brought into contact with the heater plate 144 to heat the heater plate 144. The heating main body 1431 is disposed higher than the lower end of the housing 152.

The heating terminal 1432 receives power from the thermostat 146 through the wire 147 and transfers the power to the heating main body 1431. A plurality of heating terminals 1432 are provided at both ends of the heating main body 1431. The plurality of heating terminals 1432 are extended from both ends of the heating main body 1431 and formed to be inclined downward. That is, the plurality of heating terminals 1432 are formed to protrude downward from a plane formed by the lower end of the heating main body 1431.

The heater plate 144 is heated by the heating element 143 to heat the cover base 1411 of the heater cover 141. The heater plate 144 uniformly distributes the heat of the heating element 143 to uniformly heat the heater cover 141. The heater plate 144 is formed in a bowl shape. The circumferential inner surface of the heater plate 144 is in contact with the heating element 143, but the circumferential outer surface thereof is spaced apart from the heater cover 141. A heater shield 145 is disposed below the heater plate 144.

Figures 7, 8:
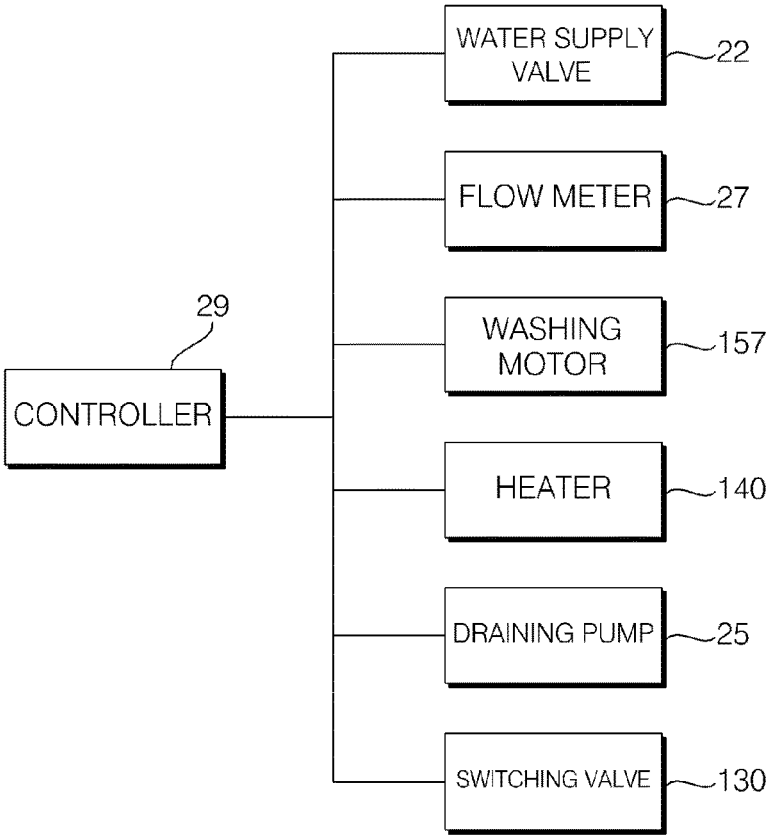
FIG. 7 is a block diagram of a dishwasher according to an embodiment of the present invention.
FIG. 8 is a view showing each process in a method of controlling a dishwasher according to an embodiment of the present invention.

FIG. 7 is a block diagram of a dishwasher according to an embodiment of the present invention, and FIG. 8 is a view showing each process in a method of controlling a dishwasher according to an embodiment of the present invention.

A controller 29 receives the flow rate of the washing water measured by the flow meter 27, and controls the water supply valve 22, the washing motor 157 of the washing pump 150, the heater 140, the draining pump 25, and the switching valve 130 to perform washing for the washing object. The controller 29 performs each process according to the washing course selected by a user.

In the present embodiment, the controller 29 sequentially performs a preliminary washing 1 P310, a preliminary washing 2 P320, a preliminary washing 3 P330, a steam washing P340, a main washing P350, a rinsing P360, and a heat rinsing P370.

A plurality of preliminary washings P310, P320, P330 are a process for spraying washing water on the washing object to remove dirt attached to the washing object. In each of the plurality of preliminary washings P310, P320, P330, the controller 29 controls the water supply valve 22 to supply the washing water from the external water source into the sump 100. After the water supply, the controller 29 operates the washing pump 150 to send the washing water in the sump 100 and controls the switching valve to spray the washing water through at least one of the plurality of spray arms 13, 14, and 15. The washing water sprayed through at least one of the plurality of spray arms 13, 14, and 15 drops the dirt attached to the washing object onto the bottom 12*b* of the tub 12 and collects it in the filter 26. After spraying the washing water, the controller 29 operates the draining pump 25 to drain the washing water in the sump 100 to the outside.

In the present embodiment, it is illustrated that the preliminary washing P310, P320, P330 is performed three times, but may be performed at least once, i.e., various number of times, according to the embodiment.

The steam washing P340 is a process in which heated washing water is sprayed on a washing object and steam is applied to the washing object to sterilize and to soak the washing object. Details of the steam washing P340 will be described later with reference to FIG. 9.

The main washing P350 is a process of heating the washing object by spraying the heated washing water onto the washing object and removing the dirt attached to the washing object. During the main washing P350, the controller 29 controls the water supply valve 22 to supply the washing water from the external water source to the sump 100, and then controls the heater 140 to heat the washing water, operates the washing pump 150 to spray the heated washing water through at least one of the plurality of spray arms 13, 14, and 15, and then operates the draining pump 25 to drain the washing water in the sump 100 to the outside. During the main washing P350, the washing detergent may be mixed with the washing water.

The rinsing P360 is a process for removing residual dirt attached to the washing object. In the rinsing P360, the controller 29 controls the water supply valve 22 to supply the washing water from the external water source to the sump 100, and then operates the washing pump 150 to spray the washing water through at least one of the plurality of spray arms 13, 14, and 15, and then operates the draining pump 25 to drain the washing water in the sump 100 to the outside. During the rinsing P360, the rinsing detergent may be mixed with the washing water.

The heat rinsing P370 is a process for heating the washing object by spraying heated washing water onto the washing object. In the heat rinsing P370, the controller 29 controls the water supply valve 22 to supply the washing water from the external water source to the sump 100, and then controls the heater 140 to heat the washing water, operates the washing pump 150 to spray the heated washing water through at least one of the plurality of spray arms 13, 14, and 15, and then operates the draining pump 25 to drain the washing water in the sump 100 to the outside.

According to the embodiment, the steam washing P340 may be performed between the main washing P350 and the rinsing P360, between the rinsing P360 and the heat rinsing P370, or after the heat rinsing P370.

Figure 9:
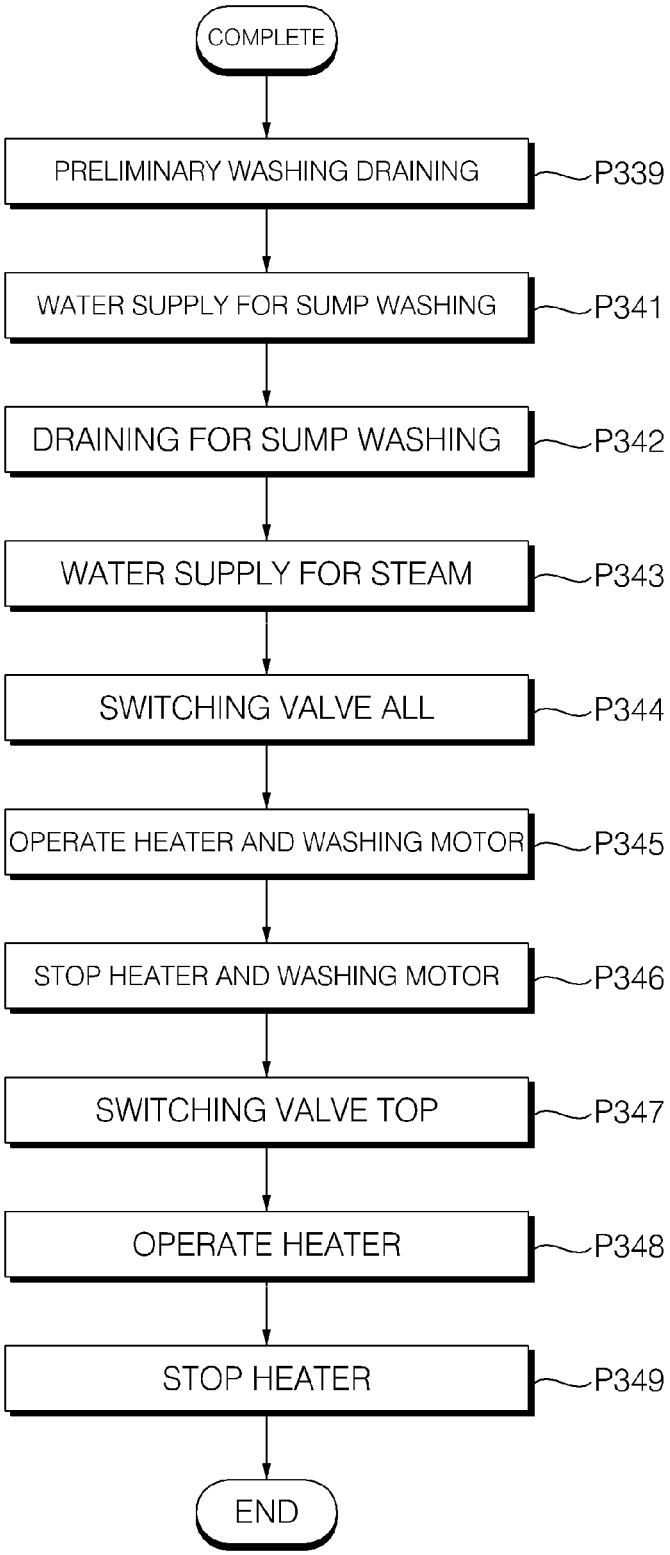
FIG. 9 is a flowchart showing a method of controlling a dishwasher according to an embodiment of the present invention.
Figure 10:
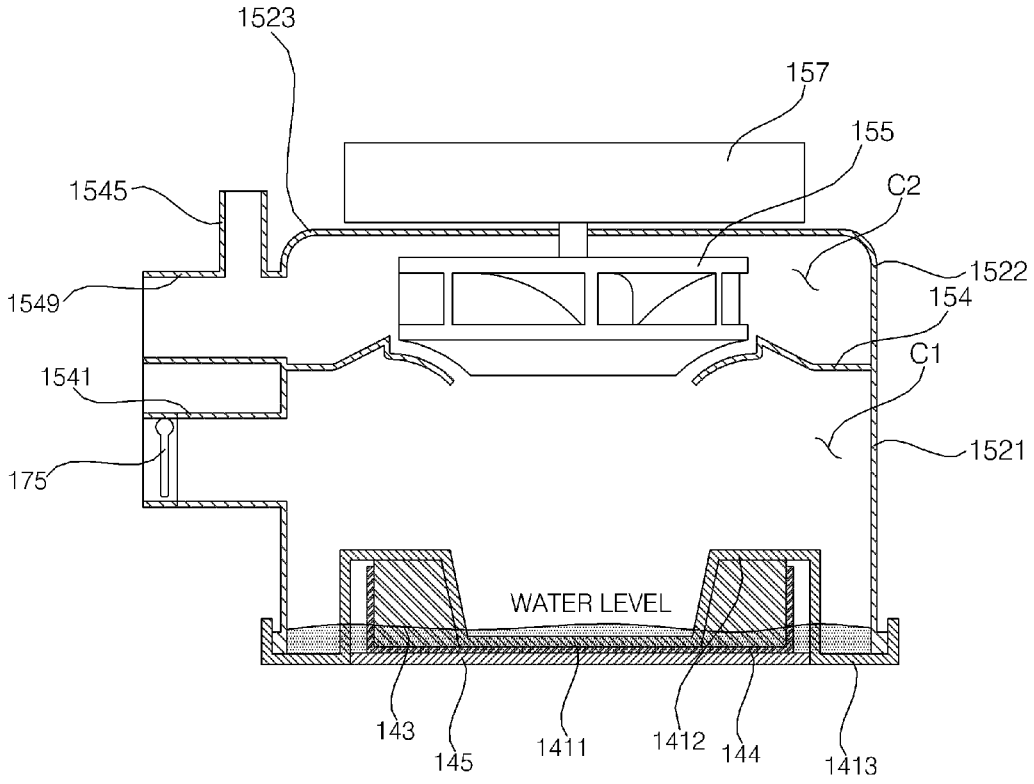
FIG. 10 is a view showing the state of a washing pump after completion of sump washing in a method of controlling a dishwasher according to an embodiment of the present invention.
Figure 11:
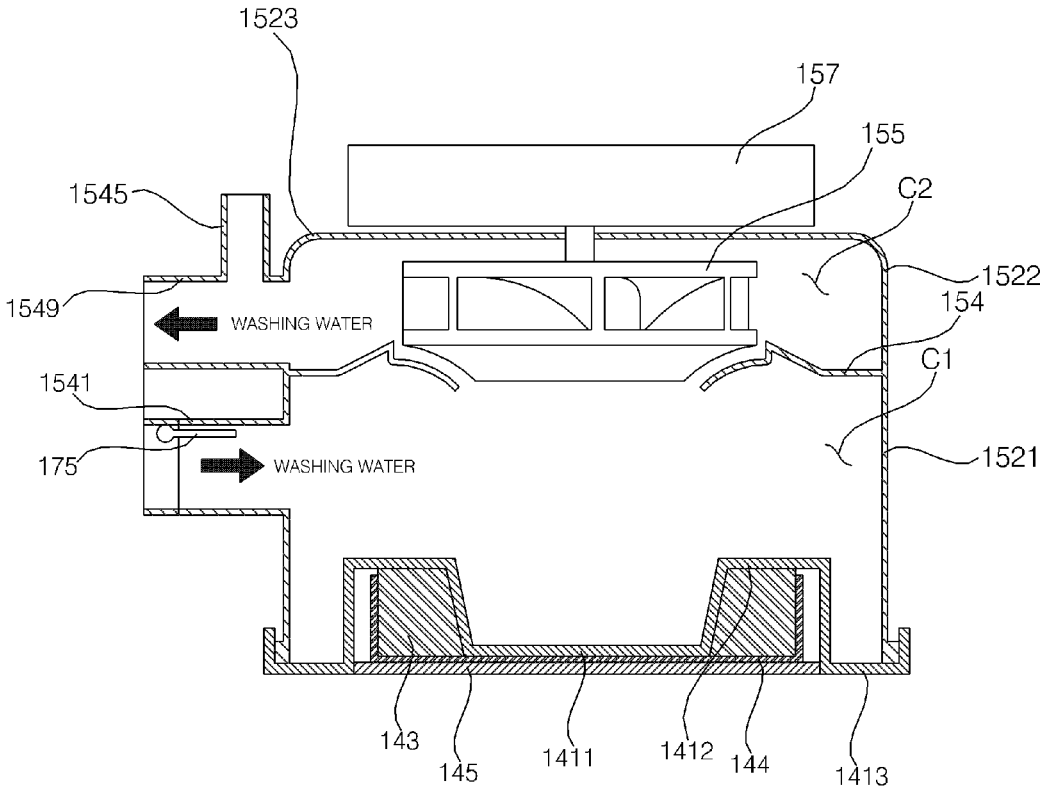
FIG. 11 is a view showing the state of a washing pump during hot water circulation in a method of controlling a dishwasher according to an embodiment of the present invention.
Figure 12:
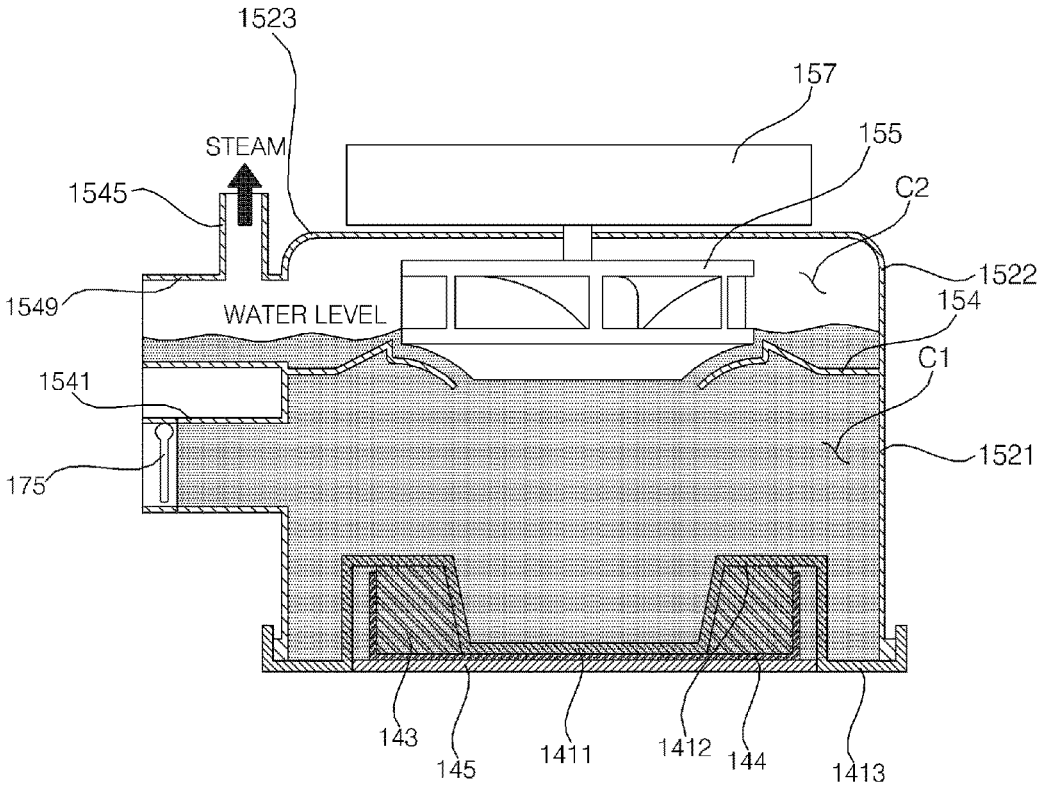
FIG. 12 is a view showing the state of a washing pump when starting a steam generation in a method of controlling a dishwasher according to an embodiment of the present invention.
Figure 13:
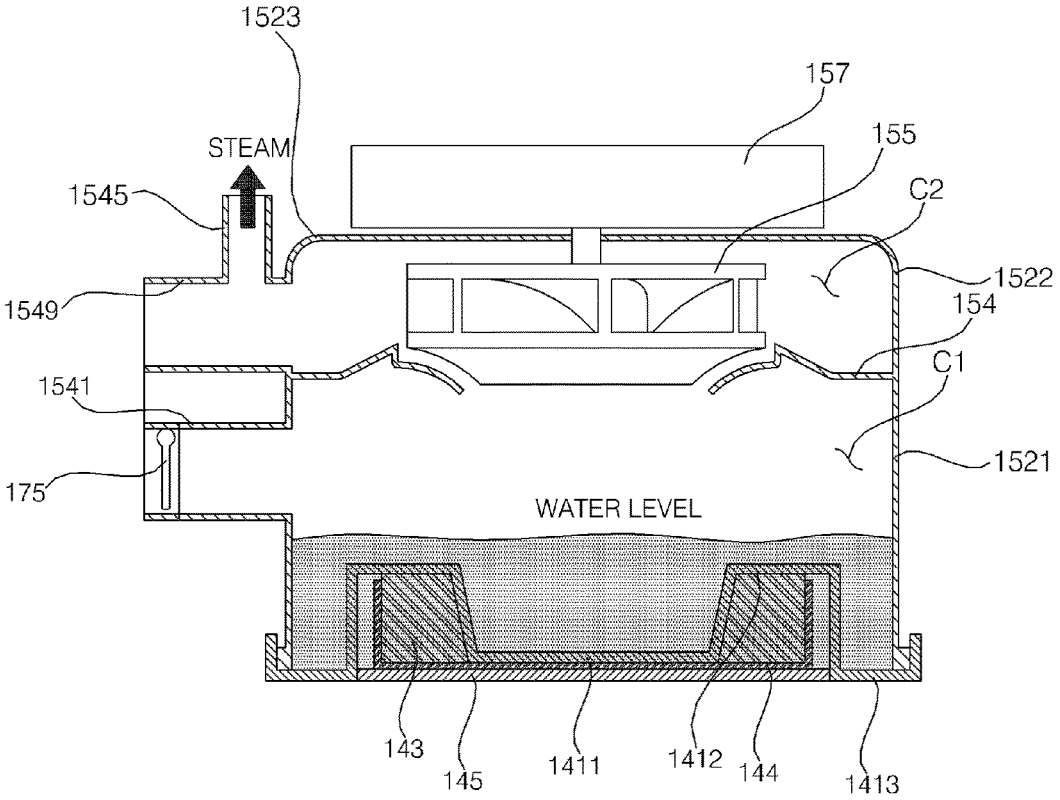
FIG. 13 is a view showing the state of a washing pump when a steam generation is completed in a method of controlling a dishwasher according to an embodiment of the present invention.

FIG. 9 is a flowchart showing a method of controlling a dishwasher according to an embodiment of the present invention, FIG. 10 is a view showing the state of a washing pump after completion of sump washing in a method of controlling a dishwasher according to an embodiment of the present invention, FIG. 11 is a view showing the state of a washing pump during hot water circulation in a method of controlling a dishwasher according to an embodiment of the present invention, FIG. 12 is a view showing the state of a washing pump when starting a steam generation in a method of controlling a dishwasher according to an embodiment of the present invention, and FIG. 13 is a view showing the state of a washing pump when a steam generation is completed in a method of controlling a dishwasher according to an embodiment of the present invention.

The controller 29 performs a preliminary washing draining P339 at a final step of the preliminary washing 3 P330. In the preliminary washing draining P339, the controller 29 operates the draining pump 25 to drain the washing water stored in the sump 100 to the outside. When the controller 29 operates the draining pump 25, the washing water stored in the sump 100 is discharged to the outside of the case 11 through the drainage flow path 24.

When all of the washing water stored in the sump 100 is drained, the controller 29 stops the draining pump 25 and performs the steam washing P340.

The controller 29 performs a water supply for sump washing P341 of the steam washing P340. In the water supply for sump washing P341, the controller 29 opens the water supply valve 22 to supply the washing water from the external water source to the sump 100. When the controller 29 opens the water supply valve 22, the washing water supplied from the external water source flows into the sump 100 through the water supply flow path 23. The controller 29 closes the water supply valve 22 when it is determined that a proper amount of washing water is supplied to the sump 100 at the flow rate of the washing water measured by the flow meter 27.

When the water supply for sump washing P341 is completed, the controller 29 performs a draining for sump washing P342. In the draining for sump washing P342, the controller 29 operates the draining pump 25 to drain the washing water supplied to the sump 100 to the outside through the drainage flow path 24. At this time, the dirt in the sump 100 is discharged to the outside through the drainage flow path 24 along with the washing water. The controller 29 stops the draining pump 25 when sensing that all the washing water in the sump 100 has been drained through the draining motor of the draining pump 25.

During the draining for sump washing P342, the washing water inside the housing 152 of the washing pump 150 flows to the sump 100 through a gap between the lower end of the check valve 175 and the lower portion of the washing water intake pipe 1541 and then discharged to the outside through the drainage flow path 24. Accordingly, as shown in FIG. 10, when the draining for sump washing P342 is completed, no washing water or very little washing water is stored inside the housing 152 of the washing pump 150. When the draining for sump washing P342 is completed, the water level of the washing water inside the housing 152 of the washing pump 150 is lower than the upper end of the heater 140.

The controller 29 does not operate the washing motor 157 of the washing pump 150 and the heater 140 from the start of the water supply for sump washing P341 to the completion of the draining for sump washing P342. The water supply for sump washing P341 and the draining for sump washing P342 are steps for removing dirt inside the sump 100 (and the washing pump 150), and remove dirt in the sump 100 by supplying the washing water to the sump 100, and then draining the washing water intactly.

When the draining for sump washing P342 is completed, the controller 29 performs a water supply for steam P343. During the water supply for steam P343, the controller 29 opens the water supply valve 22 to supply the washing water from the external water source to the sump 100. When the controller 29 opens the water supply valve 22, the washing water supplied from the external water source flows into the sump 100 through the water supply flow path 23. The controller 29 closes the water supply valve 22 when it is determined that a proper amount of washing water has been supplied to the sump 100 at the flow rate of the washing water measured by the flow meter 27.

During the water supply for steam P343, it is preferable that the water level of the washing water supplied to the sump 100 is lower than the water level of the washing water supplied to the sump 100 during the water supply of the plurality of preliminary washings P310, P320 and P330, the main washing P350, the rinsing P360, and the heat rinsing P370. In addition, it is preferable that the water level of the washing water is supplied to the sump 100 during the water supply for steam P343 is lower than the water level of the washing water supplied to the sump 100 during the water supply for sump washing P341. The amount of the washing water supplied to the sump 100 during the water supply for steam P343 is satisfactory as long as the washing water supplied to the sump 100 fills the housing 152 of the washing pump 150. In the amount of the washing water supplied to the sump 100 during the water supply for steam P343, it is preferable that the water level is lower than the lowermost end of the steam discharge pipe 1545 when the washing water flows into the housing 152 of the washing pump 150.

As shown in FIG. 10, even if the water supply for steam P343 is completed, no washing water or very little washing water is stored inside the housing 152 of the washing pump 150. Since the check valve 175 is closed during the water supply for steam P343, the water level of the washing water inside the housing 152 of the washing pump 150 is lower than the upper end of the heater 140 when the draining for sump washing P342 is completed.

When the water supply for steam P343 is completed, the controller 29 controls the switching valve 130 to connect the washing pump 150 to all of the plurality of spray arms 13, 14, and 15 (P344). The controller 29 controls the switching valve 130 so that the washing water supply path 180 is connected to all of the plurality of spray arm connecting flow paths 18, 19, and 21.

When the control of the switching valve 130 of the controller 29 is completed, the controller 29 operates the heater 140 and the washing motor 157 to circulate the hot water (P345). The controller 29 operates the heater 140 to heat the washing water flowing in the housing 152 of the washing pump 150, and operates the washing motor 157 to send the heated washing water to all of the plurality of spray arms 13, 14, and 15. The controller 29 simultaneously operates the heater 140 and the washing pump 150 to spray the heated washing water through all of the plurality of spray arms 13, 14, and 15. The heated washing water sprayed through all of the plurality of spray arms 13, 14 and 15 is applied to the washing object and then flows to the bottom 12*b* of the tub 12 and is collected in the sump 100. The washing water collected in the sump 100 flows to the washing pump 150 and is heated and sent.

Referring to FIG. 11, when the controller 29 operates the washing motor 157, the check valve 175 is opened so that the washing water stored in the sump 100 is filled in the housing 152 through the water collecting flow path 170 and the washing water intake pipe 1541, and then sent to the plurality of spray arms 13, 14 and 15 through the washing water outflow pipe 1549.

The controller 29 stops the heater 140 and the washing motor 157 when a set time is elapsed, thereby completing a hot water circulation (P346). Referring to FIG. 12, when the controller 29 stops the washing motor 157, the check valve 175 is closed so that the heated washing water is stored in the housing 152. The water level of the washing water stored in the housing 152 is higher than the uppermost end of the heater 140 and lower than the lowermost end of the steam discharge pipe 1545.

The above described hot water circulation through the operation of the heater 140 and the washing motor 157 may be omitted depending on an embodiment.

When the hot water circulation is completed, the controller 29 controls the switching valve 130 so that the washing pump 150 is connected to the top spray arm 15 which is a spray arm disposed at the uppermost end among the plurality of spray arms 13, 14 and 15 (P347). The controller 29 controls the switching valve 130 so that the washing water supply path 180 is connected to the top spray arm connecting flow path 21.

When the control of the switching valve 130 of the controller 29 is completed, the controller 29 operates the heater 140 to generate steam (P348). The controller 29 operates the heater 140 to generate steam while maintaining the washing water in the housing 152 at a certain level or higher.

In a steam generation method according to an embodiment, the controller 29 operates only the heater 140 while the washing motor 157 is stopped and heats the washing water stored in the housing 152 of the washing pump 150. The certain level in the present embodiment may be based on the upper end of the heating element 143 of the heater 140. Accordingly, the controller 29 can generate steam by operating the heater 140 while maintaining the water level higher than the upper end of the heating element 143 of the heater 140 in a state where the washing motor 157 is stopped.

When the heater 140 heats the washing water that is not flowing in the housing 152 to a high temperature, steam is generated inside the housing 152. Since the washing water in the housing 152 should be vaporized when steam is generated, the controller 29 does not operate the washing motor 157 and maintains a stopped state. The steam generated inside the housing 152 flows to the steam nozzle 195 through the steam discharge pipe 1545 and the steam hose 190. The steam discharged from the steam nozzle 195 is applied to the washing object.

Referring to FIG. 12, since the washing motor 157 is stopped when steam is generated, the check valve 175 is closed so that the washing water heated during the hot water circulation is stored in the housing 152. The heater 140 heats the heated washing water stored in the housing 152 to generate steam.

Most of the steam generated inside the housing 152 of the washing pump 150 flows into the steam hose 190 through the steam discharge pipe 1545 without flowing into the washing water supply path 180 through the washing water outflow pipe 1549. Since the cross sectional area of the flow path of the washing pump 150 connected to the top spray arm 15 is smaller than the cross sectional area of the flow path connected to the other spray arm, and the height of the flow path of the washing pump 150 connected to the top spray arm 15 is higher than height of the flow path connected to the other spray arm, most of the steam generated in the housing 152 flows to the steam hose 190 through the steam discharge pipe 1545 in a state where the switching valve 130 connects the washing pump 150 to the top spray arm 15.

In the above-described steam generation, the controller 29 operates the heater 140 at a temperature higher than the hot water circulation P345. That is, the temperature at which the heater 140 heats the washing water during the steam generation is higher than the temperature at which the heater 140 heats the washing water during the hot water circulation P345. The controller 29 operates the heater 140 at a temperature of 100 degrees Celsius or more, and it is preferable that the actual washing water is heated to 100 degrees Celsius.

The controller 29 stops the heater 140 to complete the steam generation when a set time is elapsed (P349). It is preferable that the controller 29 makes the execution time of the steam generation P348 in which only the heater 140 is operated to be longer than the execution time of the hot water circulation P348 in which the heater 140 and the washing motor 157 are simultaneously operated.

The controller 29 performs the hot water circulation P348 such that the washing water stored in the sump 100 passes through the check valve 175 and is sufficiently introduced into the housing 152 of the washing pump 150 to be stored therein. The controller 29 performs steam generation P348 so that the water level of the washing water inside the housing 152 which is lowered by the steam generation is not lowered than the upper end of the heating element 143 of the heater 140.

Referring to FIG. 13, when the steam generation is completed, the water level of the washing water inside the housing 152 is lowered. Since the amount of steam supplied into the tub 12 during the steam generation is limited to the amount of washing water that can be stored inside the housing 152, it is necessary to supply the washing water to the inside of the housing 152 again after the steam generation so as to supply more steam into the tub 12.

After completing the steam generation, the controller 29 controls the switching valve 130 to connect the washing pump 150 to all of the plurality of spray arms 13, 14 and 15 (P344) and to operate the heater 140 and the washing motor 157 (P345) to perform the hot water circulation again. In addition, the controller 29 stops the heater 140 and the washing motor 157 (P346) to complete a second hot water circulation, and then controls the switching valve 130 so that the washing pump 150 is connected to the top spray arm 15 and the heater 140 is operated (P348) to perform the steam generation again.

In the steam generation method according to another embodiment, the controller 29 operates the heater 140 while operating the washing motor 157 to heat the washing water stored inside the housing 152 of the washing pump 150. The certain water level in the present embodiment may be formed higher than the upper end of the heating element 143 of the heater 140. However, in the present embodiment, the certain water level may be formed lower than the water level of the state where the heated washing water is stored in the housing 152 as the washing motor 157 is stopped and the check valve 175 is closed, in a state where the hot water circulation is completed.

The heater 140 heats the washing water to a high temperature while the water level inside the housing 152 is maintained at a certain level, so that steam is generated inside the housing 152. In this case, a part of the washing water inside the housing 152 may flow, but the flow thereof may be slight so that the washing water inside the housing 152 is vaporized. The impeller 155 may be rotated so that the washing water having the above-mentioned level flows, and both the steam and the heated washing water may be discharged to the steam nozzle 195 due to the rotation of the impeller 155.

In the steam generation method according to the present embodiment, since the impeller 155 is rotated, the water level of the washing water existing inside the housing 152 can be maintained at a certain level or higher. Therefore, unlike the case of generating steam while stopping the impeller 155, the water level of the washing water existing inside the housing 152 can be maintained to some extent. This is advantageous in that it is not necessary to repeat the hot water circulation (P348) process for supplying the washing water into the housing 152 in order to maintain the water level of the washing water inside the housing 152 at a certain level or higher.

After completing the steam generation, the controller 29 operates the draining pump 25 to drain the washing water stored in the sump 100 to the outside and performs the main washing (P350).

After completing the steam generation, the controller 29 does not drain and controls the water supply valve 22 to additionally supply the washing water from the external water source to the sump 100, and then may perform the main washing (P350). In this case, the hot water generated during the steam generation can be used, thereby saving the energy used for the heater 140.

According to the dishwasher of the present invention and the controlling method therefor, one or more of the following effects can be obtained.

First, as the steam is generated from the pump after the sump is washed, the decrease of steam generation due to the dirt and the pump failure can be prevented.

Second, the steam is smoothly discharged while reducing the waste of energy and generating the steam quickly, by controlling the amount of washing water that is supplied during water supply before the steam is generated.

Third, the washing water stored in the sump is transferred to the pump by circulating washing water before steam generation.

Fourth, the steam is generated quickly by preheating the washing water when the washing water is circulated before steam generation.

Fifth, the water level of the washing water existing inside the washing pump is maintained at a certain level or higher to prevent the overheat of the heater due to lack of washing water.

Sixth, the loss of steam through the washing water circulating flow path can be minimized by connecting the washing pump to the spray arm disposed in the uppermost end during steam generation.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A method of controlling a dishwasher that includes a plurality of spray arms configured to spray washing water to a washing chamber, a steam nozzle configured to spray steam, a sump configured to store washing water, and a washing pump configured to receive washing water from the sump and to heat washing water in the washing pump, the method comprising:

performing a preliminary washing process that comprises supplying washing water to the sump from an external water source, operating the washing pump to supply washing water in the sump to at least one of the plurality of spray arms, and operating a drain pump to discharge washing water in the sump to an outside;

after performing the preliminary washing process, washing the sump by supplying washing water to the sump through a water supply flow path that connects the external water source to the sump and draining washing water from the sump, the water supply flow path being located outside of the washing chamber; and after washing the sump, performing a steam washing process that comprises:

supplying washing water to the sump from the external water source, supplying washing water from the sump to the washing pump, maintaining a water level of washing water in the washing pump vertically higher than or equal to a reference water level, and generating steam from the washing pump by heating washing water in the washing pump while the water level of washing water in the washing pump is maintained vertically higher than or equal to the reference water level, and wherein draining washing water during washing the sump comprises receiving, at the sump, washing water from the washing pump, and discharging the received washing water through a drainage flow path connected to the sump, wherein the dishwasher further comprises a check valve located at a washing water intake pipe that connects the sump to the washing pump, and wherein receiving washing water from the washing pump during washing the sump comprises receiving washing water from the washing pump through a gap defined between an end of the check valve and an inner surface of the washing water intake pipe.

2. The method of claim 1, wherein washing the sump comprises washing the sump in a state in which the washing pump is not be operated.

3. The method of claim 1, wherein a water level of washing water supplied to the sump to generate steam is vertically lower than a water level of washing water supplied to the sump to wash the sump.

4. The method of claim 1, wherein the washing pump comprises a steam discharge pipe that is connected to the steam nozzle and that is configured to discharge steam generated in the washing pump, and wherein supplying washing water to the sump from the external water source comprises supplying an amount of washing water to the sump that is set to maintain the water level of washing water in the washing pump vertically lower than a lowermost end of the steam discharge pipe.

5. The method of claim 1, further comprising:

spraying washing water to a washing object to remove contaminant from the washing object; and discharging steam to the washing object, wherein discharging steam to the washing object comprises:

supplying washing water to the sump from the external water source, and generating steam from washing water supplied to the sump, wherein a water level of washing water supplied to the sump to generate steam is vertically lower than a water level of washing water supplied to the sump to spray washing water to the washing object.

6. The method of claim 1, wherein the plurality of spray arms are arranged at one or more vertical heights with respect to the washing pump, and wherein generating steam further comprises connecting the washing pump to an uppermost spray arm among the plurality of spray arms.

7. The method of claim 1, further comprising circulating hot water to at least one of the plurality of spray arms before generating steam, wherein circulating hot water comprises:

heating washing water in the washing pump, and supplying heated washing water to at least one of the plurality of spray arms.

8. The method of claim 1, wherein the preliminary washing process comprises performing a plurality of preliminary washing processes, each preliminary washing process comprising:

supplying washing water to the sump from the external water source;

operating the washing pump to supply washing water in the sump to at least one of the plurality of spray arms; and operating the drain pump to discharge washing water in the sump to the outside.

9. The method of claim 1, further comprising:

after performing the steam washing process, performing a main washing process that comprises:

supplying washing water to the sump from the external water source, heating washing water in the sump, spraying heated washing water onto a washing object through at least one of the plurality of spray arms, and draining washing water in the sump.

10. The method of claim 1, wherein the dishwasher further comprises a heater located in the washing pump, the heater being located below the washing water intake pipe, and wherein draining washing water from the sump during washing the sump is performed until a water level in the washing pump is lower than an upper end of the heater.

11. The method of claim 1, wherein the dishwasher further comprises a heater located in the washing pump, and wherein draining washing water from the sump during washing the sump is performed until a water level in the washing pump is lower than an upper end of the heater.

12. The method of claim 1, wherein the dishwasher further comprises a water supply valve and a flow meter that are located at the water supply flow path, and wherein supplying washing water through the water supply flow path comprises:

opening the water supply valve to supply washing water through the water supply flow path, determining, by the flow meter, an amount of washing water supplied to the sump, and closing the water supply valve based on the amount of washing water supplied to the sump reaching a preset amount.

13. The method of claim 7, wherein generating steam further comprises:

based on completion of circulating hot water, further heating heated washing water in the washing pump to generate steam while maintaining the water level of washing water in the washing pump vertically higher than or equal to the reference water level.

14. The method of claim 7, wherein circulating hot water comprises circulating hot water for a first period of time, and wherein generating steam further comprises generating steam for a second period of time that is greater than the first period of time.

15. The method of claim 7, further comprising repeating at least one of circulating hot water or generating steam.

16. The method of claim 7, wherein heating washing water in the washing pump comprises heating washing water to a first temperature, and wherein generating steam comprises increasing a temperature of washing water in the washing pump to a second temperature that is greater than the first temperature.

17. The method of claim 7, wherein circulating hot water further comprises supplying heated water from the washing pump to all of the plurality of spraying arms.

18. The method of claim 7, wherein circulating hot water further comprises opening the check valve to allow washing water to flow from the sump to the washing pump.

19. The method of claim 8, wherein washing the sump is performed based on completion of at least three of the plurality of preliminary washing processes.

20. A method of controlling a dishwasher that includes a plurality of spray arms configured to spray washing water to a washing chamber, a steam nozzle configured to spray steam, a sump configured to store washing water, and a washing pump configured to receive washing water from the sump and to heat washing water in the washing pump, the method comprising:

performing a preliminary washing process that comprises supplying washing water to the sump from an external water source, operating the washing pump to supply washing water in the sump to at least one of the plurality of spray arms, and operating a drain pump to discharge washing water in the sump to an outside;

after performing the preliminary washing process, washing the sump by supplying washing water to the sump through a water supply flow path that connects the external water source to the sump and draining washing water from the sump, the water supply flow path being located outside of the washing chamber; and after washing the sump, performing a steam washing process that comprises:

supplying washing water to the sump from the external water source, supplying washing water from the sump to the washing pump, maintaining a water level of washing water in the washing pump vertically higher than or equal to a reference water level, and generating steam from the washing pump by heating washing water in the washing pump while the water level of washing water in the washing pump is maintained vertically higher than or equal to the reference water level, and wherein draining washing water during washing the sump comprises receiving, at the sump, washing water from the washing pump, and discharging the received washing water through a drainage flow path connected to the sump, wherein the dishwasher further comprises a heater located in the washing pump, and wherein draining washing water from the sump during washing the sump is performed until a water level in the washing pump is lower than an upper end of the heater.

* * * * *